US007717094B2

(12) United States Patent
Yamamoto et al.

(10) Patent No.: US 7,717,094 B2
(45) Date of Patent: May 18, 2010

(54) CANISTER ARRANGEMENT IN POWER GENERATING APPARATUS

(75) Inventors: Masanobu Yamamoto, Shizuoka-ken (JP); Takahide Sugiyama, Shizuoka-ken (JP)

(73) Assignee: Yamaha Motor Power Products Kabushiki Kaisha, Shizuoka (JP)

( * ) Notice: Subject to any disclaimer, the term of this patent is extended or adjusted under 35 U.S.C. 154(b) by 49 days.

(21) Appl. No.: 12/110,014

(22) Filed: Apr. 25, 2008

(65) Prior Publication Data

US 2008/0271716 A1 Nov. 6, 2008

(30) Foreign Application Priority Data

Apr. 25, 2007 (JP) ..... 2007-116076

(51) Int. Cl.
*F02M 33/02* (2006.01)

(52) U.S. Cl. ..... 123/519; 123/518

(58) Field of Classification Search ..... 123/519, 123/520, 518, 516

See application file for complete search history.

(56) References Cited

U.S. PATENT DOCUMENTS 7,341,046 B2 * 3/2008 Leymarie et al. ..... 123/509
7,435,289 B2 * 10/2008 Shears et al. ..... 96/134

FOREIGN PATENT DOCUMENTS

JP 07-034985 2/1995
JP 07034985 * 2/1995

OTHER PUBLICATIONS

U.S. Appl. No. 12/038,261, filed Feb. 27, 2008, Yamamoto et al.
U.S. Appl. No. 12/109,933, filed Apr. 25, 2008, Yamamoto et al.
U.S. Appl. No. 12/110,031, filed Apr. 25, 2008, Yamamoto et al.

* cited by examiner

*Primary Examiner*—Stephen K Cronin
*Assistant Examiner*—Raza Najmuddin
(74) *Attorney, Agent, or Firm*—Keating & Bennett, LLP

(57) ABSTRACT

A power generating apparatus has a frame, an engine disposed inwardly of the frame and configured to drive a generator, a fuel tank for storing fuel to be supplied to the engine, and a canister containing an adsorbent for adsorbing fuel vapor from the fuel tank. The canister includes a communicating tube, which places the canister in communication with the atmosphere. The canister is also in communication with an intake system. The canister is movably positioned in a space S between the frame and the intake system so as to prevent an increase in the size of the power generating apparatus when the canister is added to the power generating apparatus.

7 Claims, 6 Drawing Sheets

CANISTER ARRANGEMENT IN POWER GENERATING APPARATUS

CROSS-REFERENCE TO RELATED APPLICATIONS

The present application is based on and claims priority under 35 U.S.C. 119 to Japanese Patent Application No. 2007-116076, filed on Apr. 25, 2007, the entire contents of which is hereby incorporated by reference and should be considered part of this specification.

BACKGROUND OF THE INVENTION

1. Field of the Invention

The present invention relates to a power generating apparatus and more particularly to an arrangement of a canister containing an adsorbent for adsorbing thereonto fuel that evaporates from an engine fuel tank of the power generating apparatus.

2. Description of the Related Art

A conventional power generating device having a canister containing the evaporative fuel adsorbent is described in Japanese Publication No. JP-7-34985. The device described in JP 7-34985 includes an engine, a fuel tank for storing fuel to be supplied to the engine, and a canister containing an adsorbent for adsorbing thereonto fuel that evaporates from the fuel tank. The canister includes a communicating tube, which places the canister in communication with the atmosphere. The canister is also in communication with an intake system of the engine.

The engine is driven by fuel supplied from the fuel tank and outputs a motive force of a predetermined magnitude. During the course of this operation, as described above, the adsorbent and the canister containing the adsorbent therein generally work as follows. Evaporative fuel (e.g., fuel vapor) is roughly constantly produced in the fuel tank. During a period in which the engine is stopped or in a low-speed range of operation (e.g., idling), most of the evaporative fuel is adsorbed by the adsorbent, thereby inhibiting release of the evaporative fuel into the atmosphere.

When the engine is in a medium-speed or high-speed range of operation, a negative pressure builds up inside the intake system of the engine. The negative pressure causes atmospheric air to be sucked into the canister through the communicating tube of the canister. The evaporative fuel that is evaporated from the fuel tank and is flowing toward the canister is sucked with the air, which is sucked into the canister through the communicating tube, into the intake system and supplied to the engine, where it is subjected to combustion. The evaporative fuel that has been adsorbed onto the adsorbent is purged from the adsorbent by the air sucked through the communicating tube into the canister, and subjected to combustion as described above.

The power generating apparatus has a frame and the engine is provided inside the frame to drive the generator. However, some power generating apparatuses do not include the adsorbent and a canister containing the adsorbent therein. When the canister containing the adsorbent therein is simply added to such a power generating apparatus, the power generating apparatus can be increased in size, which is undesirable, in particular, for a portable power generating apparatus.

To prevent the power generating apparatus from being increased in size, for example, positioning the canister adjacent to the air cleaner included in the intake system of the engine to thereby attain a compact arrangement is conceivable. However, such an arrangement can cause inconvenience in that the canister obstructs maintenance of an element or the like in the air cleaner.

SUMMARY OF THE INVENTION

In view of the circumstances noted above, one aspect of the present invention is to prevent the power generating apparatus from being increased in size when a canister containing an adsorbent therein is added to the power generating apparatus.

Another aspect of the present invention is to facilitate maintenance of component parts of an engine even when the canister is added to the power generating apparatus without an increase of the power generating apparatus in size.

In accordance with one aspect of the present invention, a power generating apparatus is provided, comprising a frame, an engine disposed inside the frame and configured to drive a generator, the engine including an intake system, and a fuel tank for storing fuel to be supplied to the engine. The power generating apparatus also comprises a canister containing an adsorbent configured to adsorb thereonto fuel vapor from the fuel tank, the canister comprising a communicating tube configured to communicate the canister with the atmosphere, the canister further in communication with the intake system, the canister being positioned at least partially in a space between the frame and the intake system.

In accordance with another embodiment, a power generating apparatus is provided, comprising a frame, an engine attached to the frame and configured to drive a generator, the engine including an intake system, and a fuel tank for storing fuel to be supplied to the engine. The power generating apparatus further comprises a canister containing an adsorbent configured to adsorb thereonto fuel vapor from the fuel tank, the canister comprising a communicating tube configured to communicate the canister with the atmosphere, the canister further in communication with the intake system, and means for movably positioning the canister into and out of a space between the frame and the intake system to facilitate maintenance of the intake system.

In accordance with still another aspect of the present invention, a method for operating a power generating apparatus is provided, wherein the power generating apparatus has a frame, an engine disposed inside the frame, the engine including an intake system and configured to drive a generator, a fuel tank for supplying fuel to the engine and a canister containing an adsorbent for adsorbing fuel vapor from the fuel tank, the canister movably attached to the frame. The method comprises positioning the canister in a space between the frame and the intake system so that at least part of the canister is disposed in said space, pivoting the canister out of said space and outwardly from the frame, accessing the intake system through said space to perform maintenance thereon, and pivoting the canister into said space between the frame and the intake system when said maintenance is complete.

BRIEF DESCRIPTION OF THE DRAWINGS

These and other features, aspects and advantages of the present invention will now be described in connection with preferred embodiments of the invention, in reference to the accompanying drawings. The illustrated embodiments, however, are merely examples and are not intended to limit the invention. The drawings include the following 6 figures.

DETAILED DESCRIPTION OF THE PREFERRED EMBODIMENTS

Figure 1:
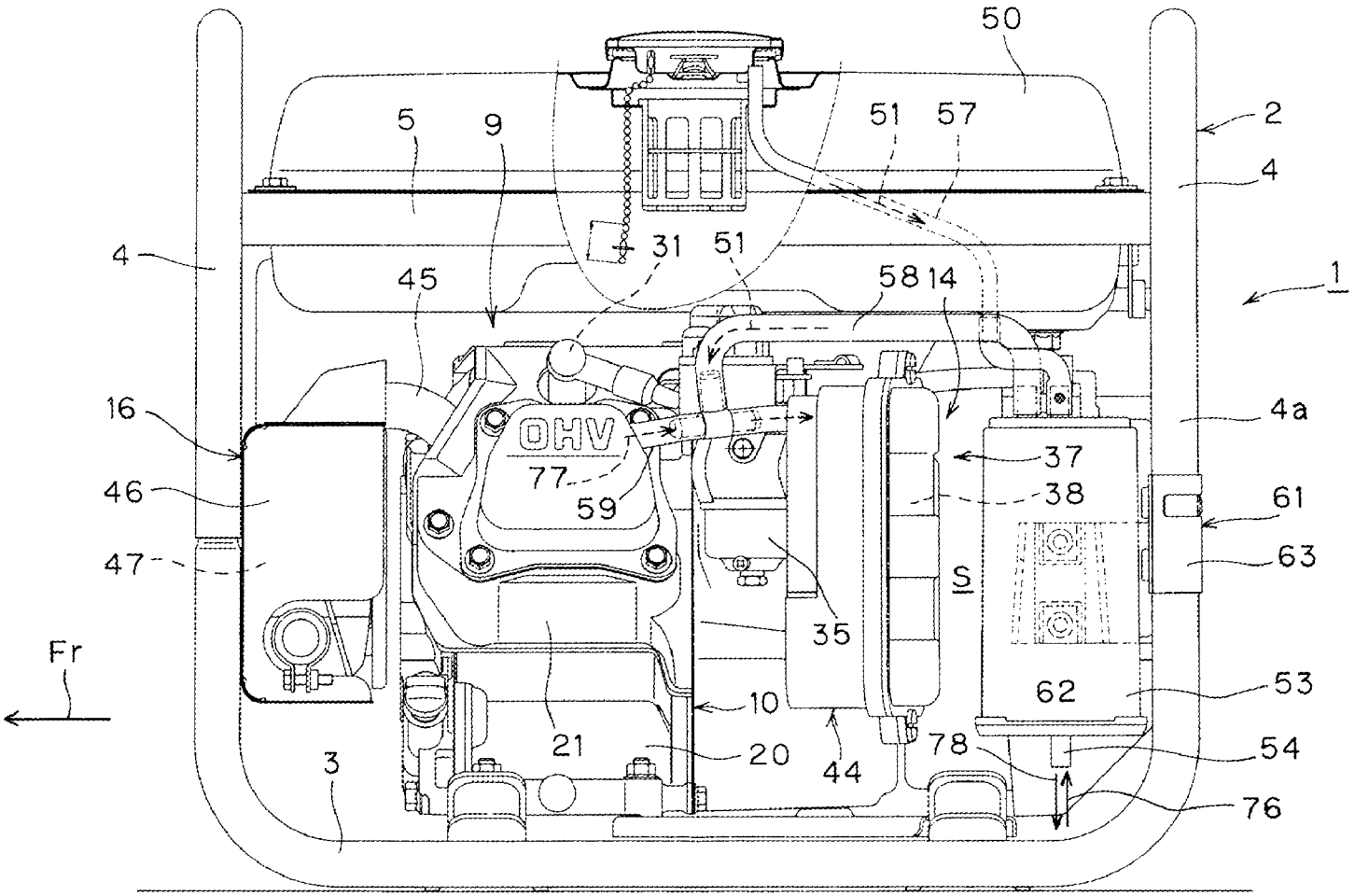
FIG. 1 is a side view of one embodiment of a power generating apparatus.
Figure 2:
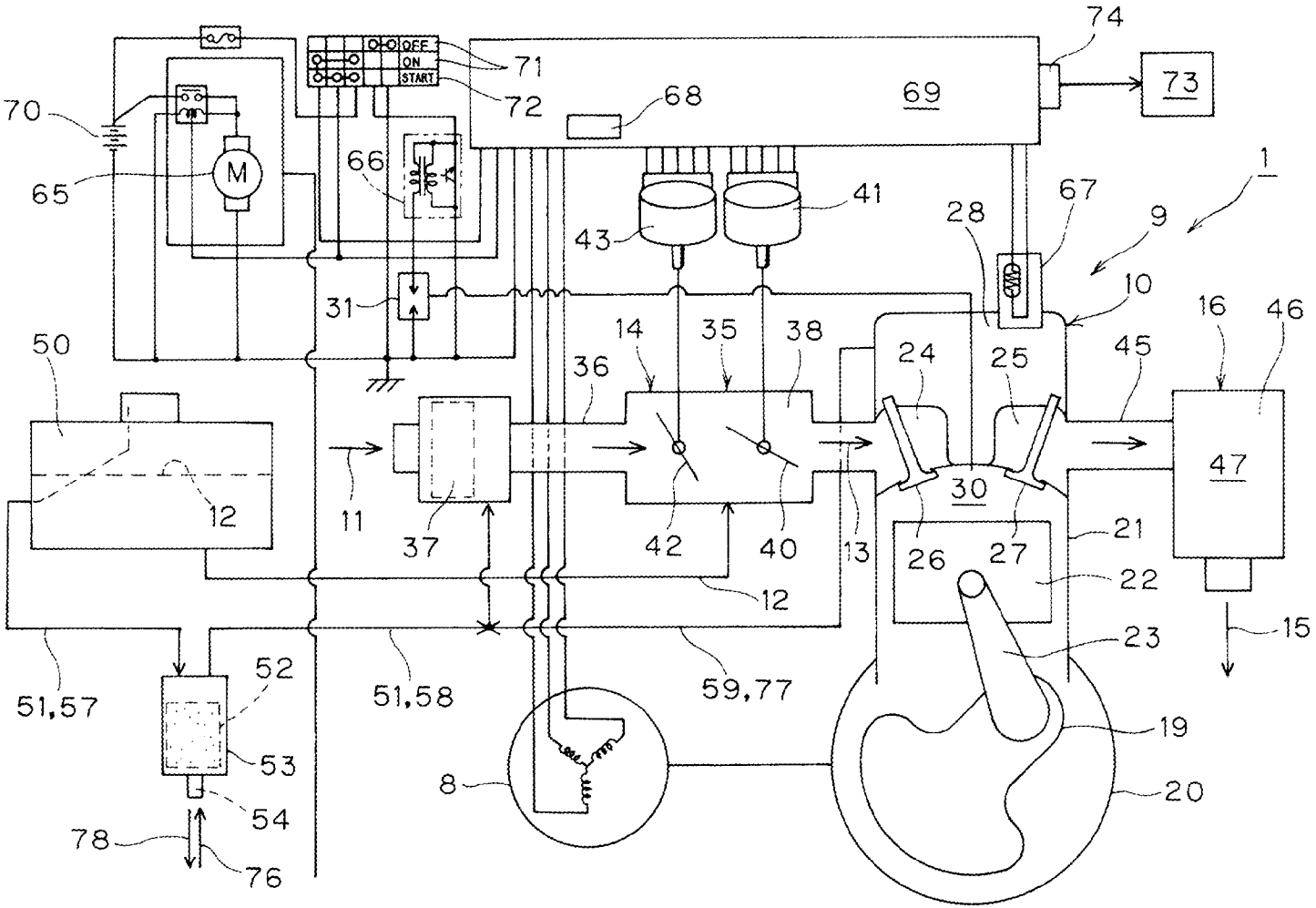
FIG. 2 is a general block diagram of the power generating apparatus.
Figure 3:
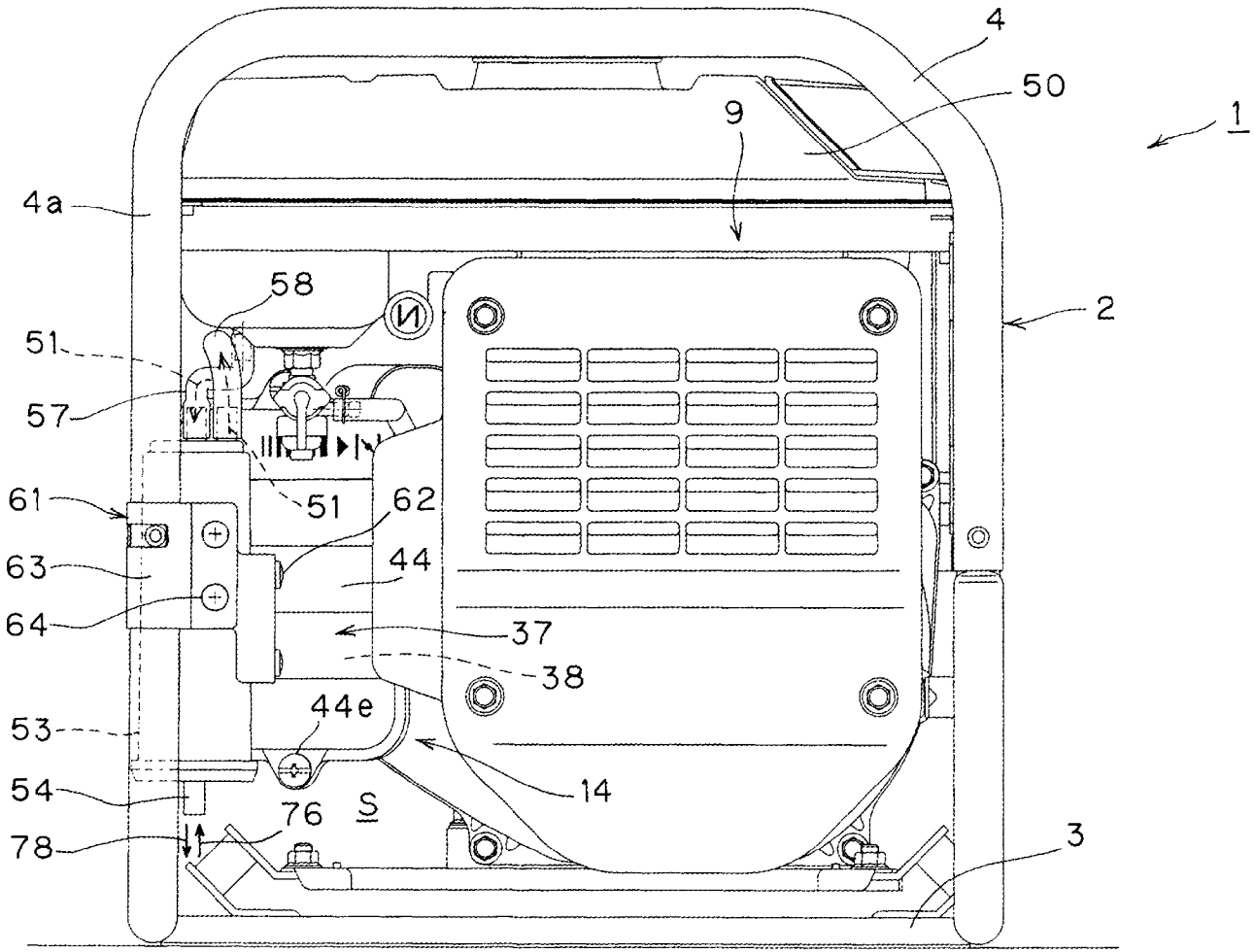
FIG. 3 is a rear view of the power generating apparatus.

In the following detailed description, terms of orientation such as "front," "rear," "left" and "right" are used herein to simplify the description of the context of the illustrated embodiments. Likewise, terms of sequence, such as "first" and "second," are used to simplify the description of the illustrated embodiments. Because other orientations and sequences are possible, however, the present invention should not be limited to the illustrated orientation. Those skilled in the art will appreciate that other orientations of the various components described above are possible.

Embodiments of the present invention relate to a canister arrangement in a power generating apparatus and aims at inhibiting the power generating apparatus from being increased in size when a canister containing an adsorbent is added to the power generating apparatus.

The power generating apparatus can have a frame, an engine provided inside the frame to drive a generator, a fuel tank for storing fuel to be supplied to the engine, and a canister containing an adsorbent for adsorbing thereonto fuel that evaporates from the fuel tank. The canister can include a communicating tube, to place the canister in communication with the atmosphere. The canister can also be in communication with an intake system of the engine. In one embodiment, the canister is positioned in a space between the frame and the intake system.

Reference numeral 1 in the drawings denotes a portable power generating apparatus. For clarity, in the following descriptions, a direction indicated by arrow Fr in the drawings is a forward direction of the apparatus.

The power generating apparatus 1 can include a frame 2 that can be placed on a working surface such as the ground or a floor surface. The frame 2 can include a chassis 3 that forms a lower end of the frame 2, a pair of front and rear upwardly-projecting handles 4 supported by front and rear ends of the chassis 3, respectively, and a pair of left and right connecting bars 5 forming left and right ends of the frame 2, respectively, and supported by the front and rear handles 4 thereacross. The handles 4 can be formed by bending a circular pipe 4*a* into an inverted U-shape.

An engine 9 (e.g., a four-cylinder engine) for driving generator 8 (e.g., an alternating current generator) can be mounted inside the frame 2 and supported by the chassis 3. The engine 9 includes an engine body 10 that outputs a driving force, an intake system 14 for supplying an air-fuel mixture 13 of air 11 and fuel 12 to the engine body 10, and an exhaust system 16 for exhausting combustion gas, which is a resultant product of combustion of the air-fuel mixture 13 in the engine body 10, to the atmosphere.

The engine body 10 can include a crankcase 20 supporting a crankshaft 19, a cylinder 21 formed on the crankcase 20 (e.g., in an upright orientation), a piston 22 axially slidably inserted into the cylinder 21, an interlocking rod 23 for interlocking between the crankshaft 19 and the piston 22, an intake valve 26 and an exhaust valve 27 for selectively opening and closing a first intake passage 24 and a first exhaust passage 25 formed in a projecting end of the cylinder 21, respectively, and a valve actuating mechanism (not shown) for selectively closing the intake and exhaust valves 26 and 27 housed in a valve actuating chamber 28 defined in the projecting end of the cylinder 21. The engine body 10 also includes a spark plug 31 with a discharging unit thereof facing a combustion chamber 30 inside the cylinder 21.

The intake system 14 can include a carburetor 35, an intake pipe 36, and an air cleaner 37, connected in series with the first intake passage 24. A space inside the carburetor 35, the intake pipe 36, and the air cleaner 37 defines a second intake passage 38, which is in communication with the first intake passage 24. The carburetor 35 can include a throttle valve 40 for adjusting an opening of the second intake passage 38, an actuator 41 serving, for example, as a step motor for actuating the throttle valve 40, a choke valve 42 for adjusting an opening of the second intake passage 38 at a position upstream of the throttle valve 40, and an actuator 42 serving, for example, as a step motor for actuating the choke valve 42.

The air cleaner 37 can include a cleaner casing 44 forming an outer shell of the air cleaner 37. The cleaner casing 44 can be fixed to the engine 9 on a side close to the carburetor 35 with at least one fastener 44*a*. The cleaner casing 44 can include a cleaner casing body 44*c*, a cleaner casing cover 44*d*, and at least one fastener 44*e*. An air inlet port 44*d*, through which the outside air 11 is introduced into the cleanser casing 44, can be defined in the cleaner casing body 44*c*. The cleaner casing cover 44*d* can releasably close the cleaner casing 44. The cleaner casing cover 44*d* can be removably fixed to the cleaner casing body 44*c* with the fastener 44*e*. An element 37*a* can be housed in the cleaner casing body 44*c*.

The exhaust system 16 can include an exhaust pipe 45 and a muffler 46, connected in series with the first exhaust passage 25. A space inside the exhaust pipe 45 and the muffler 46 is defined as a second exhaust passage 47, which is in communication with the first exhaust passage 25.

A fuel tank 50 for storing fuel 12 to be supplied to the engine 9 through the carburetor 35 can be provided above the engine 9 in the vicinity thereof. An adsorbent 52 for adsorbing thereonto evaporative fuel 51 (e.g., fuel vapor) produced in the fuel 12 in the fuel tank 50, and a canister 53 containing the adsorbent 52 therein are provided. In the illustrated embodiment, the adsorbent 52 is activated carbon. However, in other embodiments the absorbent can be other suitable materials. The canister 53 can be made of a resin and formed into a box shape of a rectangular cross section, and can be situated such that its long sides extend vertically. The canister 53 can be positioned in a vertically-elongated space S between one of the vertically-extending handles 4, formed with the pipe 4*a* of the frame 2, and the air cleaner 37 of the intake system 14. In the illustrated embodiment, substantially the entire canister 53 is positioned inside the frame 2.

The canister 53 can include, in its bottom, a communicating tube 54 which places the canister 53 in communication with the atmosphere. A first communicating passage 57, through which an upper end of the fuel tank 50 is in communication with an upper end of the canister 53, can be provided. A second communicating passage 58, through which the upper end of the canister 53 is in communication with the air cleaner 37 of the intake system 14, can also be provided. A blow-by gas passage 59, through which the valve actuating chamber 28 is in communication with the air cleaner 37 of the intake system 14, can also be provided. Each of the passages 57 to 59 can be formed of an elastic rubber hose, though other suitable materials can be used in other embodiments.

The canister 53 can be positioned to face an outer surface of the cleaner casing cover 44*d* of the cleaner casing 44 of the air cleaner 37. The canister 53 can be supported via a pivot support 61 by the handle 4 formed with the pipe 4*a* of the frame 2 such that the canister 53 is capable of pivoting movement A (see FIG. 4) away from the air cleaner 37 and the space S as well as outward with respect to the frame 2 and pivoting movement B (see FIG. 4) in a reverse direction of that of the pivoting movement A.

The pivot support 61 can include a pivot support piece 63 and at least one fastener 64. The pivot support piece 63 can attach to (e.g., clamp) the pipe 4*a* with a U-shaped first end, and supports the canister 53 at a second end with at least one fastener 62. The fastener 64 can be screwed into the U-shaped end of the pivot support piece 63 to thereby adjust a coupling force (e.g., clamping pressure) applied on the pipe 4*a* from the first end.

When the fastener 64 is screwed up, the clamping pressure increases to fix the canister 53 to the pipe 4*a* with the pivot support 61. On the contrary, when the fastener 64 is screwed down, the clamping pressure decreases. Accordingly, the canister 53 and the pivot support piece 63 of the pivot support 61 are integrally allowed to perform the pivoting movements A and B about the pipe 4*a*. Meanwhile, during the course in which the canister 53 performs the pivoting movements A and B, the hoses forming the passages 57 and 59 are each deformed so that the canister 53 performs the pivoting movements A and B smoothly (e.g., in an unconstrained manner).

The power generating apparatus 1 can include a starter motor 65 for starting the engine 9, an ignition unit 66 for causing the spark plug 31 to electrically discharge as required, a temperature sensor 67 for detecting a temperature of the engine body 10 of the engine 9, and an engine speed sensor 68 for detecting the number of revolutions of the crankshaft 19 in the engine body 10 of the engine 9.

The power generating apparatus 1 can further include a controller 69, a battery 70, main switch 71, and a starter switch 72. The controller 69 can electronically control the actuators 41 and 43, and the ignition unit 66 based on detection signals supplied from the temperature sensor 67 and the engine speed sensor 68. The battery 70 can be charged with a portion of electric power generated by the generator 8 through the controller 69, and supplies electric power to the actuators 41 and 43, the ignition unit 66, and the like. The main switch 71 switches on and off power supply from the battery 70 to the starter motor 65, the controller 69, and the like. The starter switch 72 switches on and off power supply from the battery 70 to the starter motor 65 through the main switch 71. The controller 69 includes an outlet 74 through which the other portion of the electric power generated by the generator 8 is output to an outside load 73.

When the engine 9 is driven under control of the controller 69, the outside air 11 is sucked toward inside the engine 9 through the intake system 14. The carburetor 35 mixes the fuel 12 with the thus-sucked air 11 to produce the air-fuel mixture 13. The air-fuel mixture 13 is subjected to combustion in the engine 9. Combustion gas, which is a resultant product of the combustion in the engine 9, is exhausted as the exhaust 15 through the exhaust system 16 to the outside. The engine 9, which is caused to continuously drive as described above, drives the generator 8 to output electric power. The electric power can be output to the load 73 through the outlet 74 of the controller 69.

During the above operation, the adsorbent 52 and the canister 53 work as follows. Fuel vapor 51 is roughly constantly produced in the fuel tank 51. When the engine 9 is stopped or in a low-speed range of operation (e.g., idling), most of the fuel vapor 51 is adsorbed by the adsorbent 52 through the first communicating passage 57, thereby inhibiting the fuel vapor 51 from being released into the atmosphere.

When the engine 9 is in a medium-speed or high-speed range of operation, a negative pressure builds up inside the intake system 14. The negative pressure causes the air 76 to be sucked into the canister 53 from the outside through the communicating tube 54 of the canister 53. The fuel vapor 51 that is evaporated from the fuel tank 50 and is flowing toward the canister 53 is sucked with the air 76, which is sucked into the canister 53 through the communicating tube 54, into the air cleaner 37 of the intake system 14 through the second communicating passage 58 and supplied to the engine 9, where it is subjected to combustion. The fuel vapor 51 that has been adsorbed onto the adsorbent 52 is purged from the adsorbent 52 by the air 76 sucked through the communicating tube 54 into the canister 53, and subjected to combustion in the engine 9 as in the above case.

During period in which the engine 9 is driving, blow-by gas 77 generated in the valve actuating chamber 28 is sucked into the air cleaner 37 of the intake system 14 and supplied to the engine 9 therefrom, then subjected to combustion.

According to the arrangement in the illustrated embodiment, the canister 53 is positioned in the space S between the frame 2 and the intake system 14.

This arrangement inhibits, the canister 53 from projecting outward of the frame 2 when the canister 53 containing the adsorbent 52 is added to the power generating apparatus 1, thereby inhibiting an increase of the engine 9 and power generating apparatus 1 in size.

Furthermore, as described above, the canister 53 can be positioned between the frame 2 and the intake system 14, which places the canister 53 adjacent to the intake system 14. This arrangement allows, when the canister 53 is to be brought into communication with the intake system 14 through the second communicating passage 58 as described above, to reduce the length of the second communicating passage 58 and the like, thereby reducing the size of the structure (e.g., a compact structure) for placing the canister 53 in communication with the intake system 14. Thus, even when the canister 53 is added to the power generating apparatus 1 and placed in communication with the intake system 14, an increase of the power generating apparatus 1 in size is prevented.

Meanwhile, the communicating tube 54 can be provided in the bottom of the canister 53.

When the adsorbent 52 is used over a long period of time, water 78 is likely to accumulate in the canister 53 containing the adsorbent 52 therein. According to the arrangement in the illustrated embodiment, thus-accumulated water 78 is discharged downwardly of the canister 53 smoothly and without fail through the communicating tube 54 provided in the bottom of the canister 53. Accordingly, performance of the adsorbent 52 is delivered without being inhibited by the water 78. This further facilitates the maintenance of the adsorbent 52.

Furthermore, as described above, the intake system 14 can include the air cleaner 37, and the canister 53 is supported by the frame 2 such that the canister 53 is capable of the pivoting movement A away from the air cleaner 37 as well as outward with respect to the frame 2 and the pivoting movement B in its reverse direction.

Figure 4:
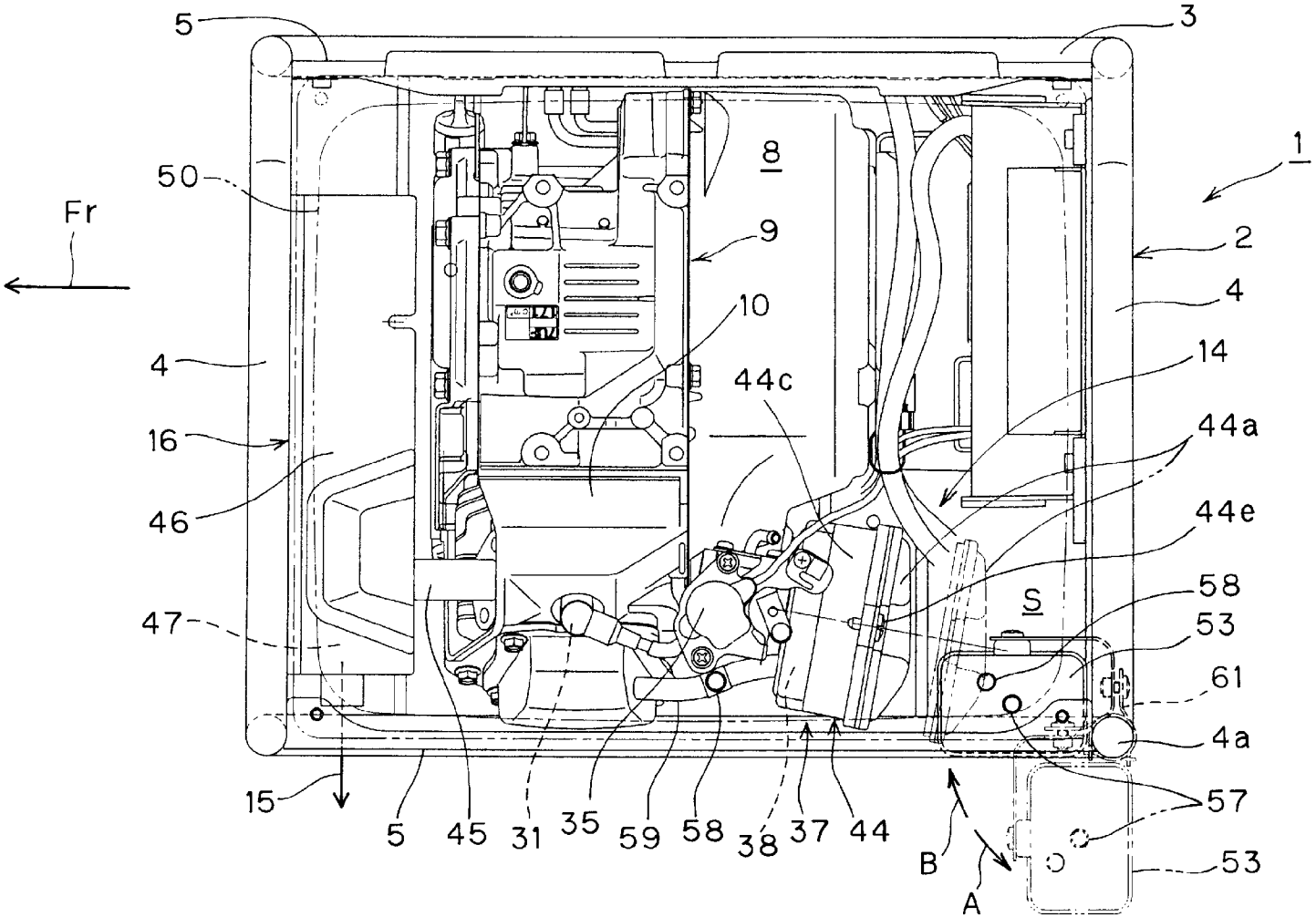
FIG. 4 is a plan view of the power generating apparatus.
Figure 5:
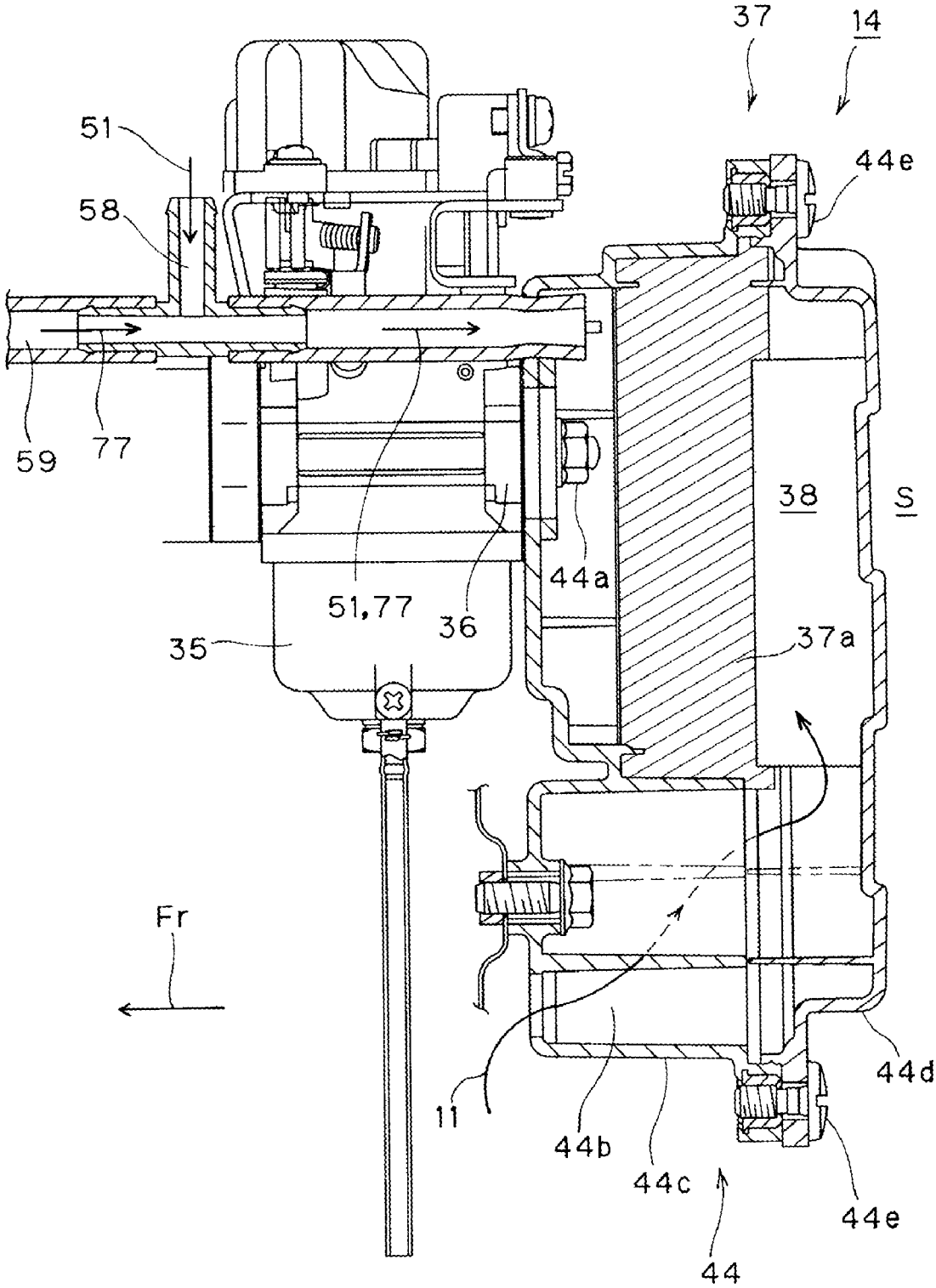
FIG. 5 is a partially-enlarged cross-sectional view of FIG. 1.
Figure 6:
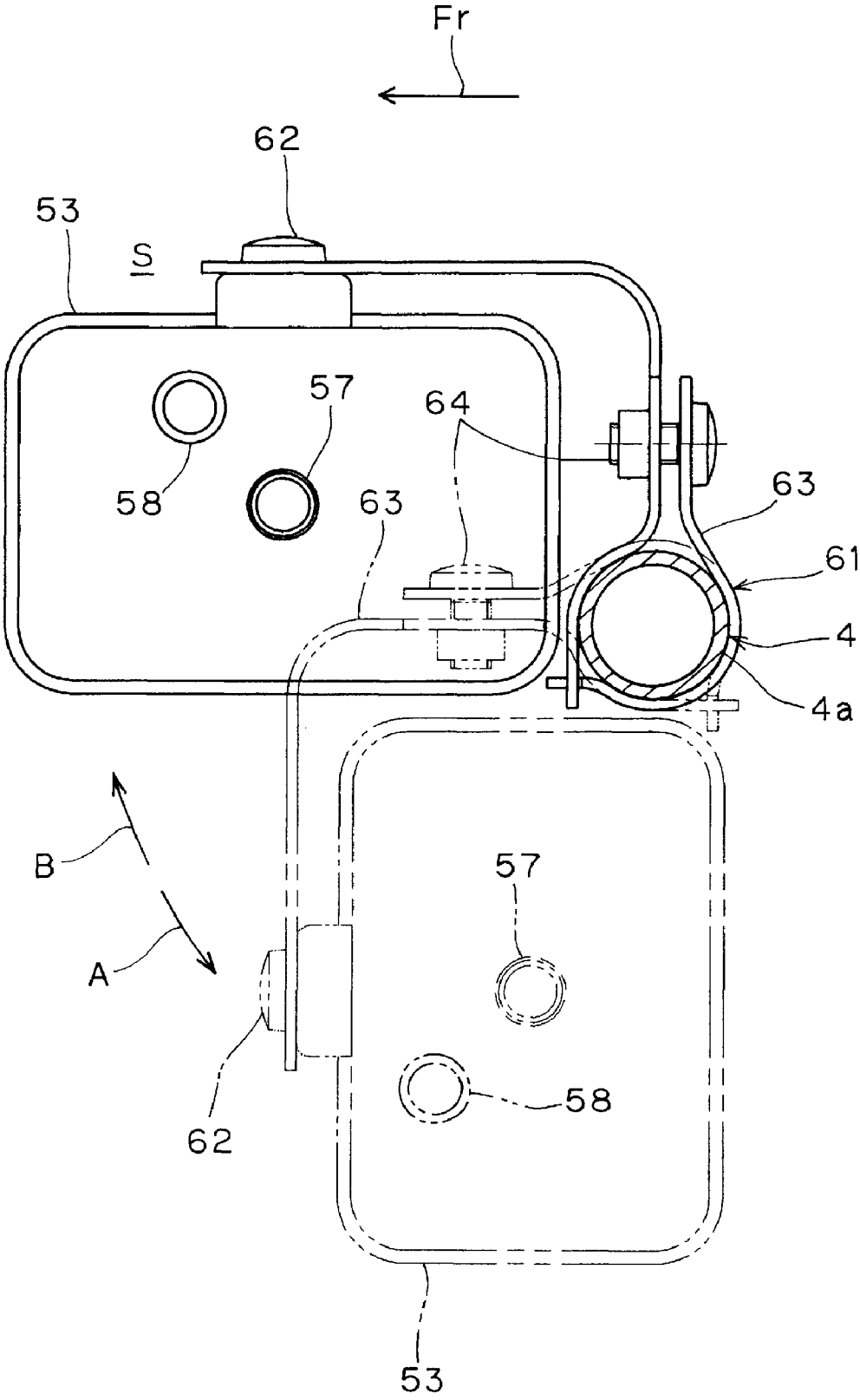
FIG. 6 is a partially-enlarged cross-sectional view of FIG. 4.

Accordingly, maintenance work on the air cleaner 37 can be performed by screwing down the fastener 64 and causing the canister 53 to perform the pivoting movement A outward of the frame 2 integrally with the pivot support piece 63 of the pivot support 61 (indicated by long dashed double-short dashed lines in FIGS. 4 and 6). When the canister 53 is caused to pivot as described above, the canister 53 is separated from an area where the canister 53 faces the cleaner casing cover

44*d* of the cleaner casing 44 of the air cleaner 37, thereby providing access to the space S between the frame 2 and the intake system 14.

Thus utilizing the space S facilitates maintenance work on the air cleaner 37. For example, the element 37*a* in the cleaner casing body 44*c* can be replaced with a new one with the cleaner casing cover 44*d* separated from the cleaner casing body 44*c* (the long dashed double-short dashed lines in FIG. 4).

As described above, the canister 53 is pivotally supported by the frame 2 by utilizing the pipe 4*a* which forms the frame 2. This advantageously simplifies the pivotal support structure of the canister 53.

The above descriptions have been made based on the drawings. However, substantially the entire canister 53 is not necessarily positioned inside the frame 2. Alternatively, the canister 53 may be only partially positioned inside the frame 2.

Although these inventions have been disclosed in the context of a certain preferred embodiments and examples, it will be understood by those skilled in the art that the present inventions extend beyond the specifically disclosed embodiments to other alternative embodiments and/or uses of the inventions and obvious modifications and equivalents thereof. In addition, while a number of variations of the inventions have been shown and described in detail, other modifications, which are within the scope of the inventions, will be readily apparent to those of skill in the art based upon this disclosure. It is also contemplated that various combinations or subcombinations of the specific features and aspects of the embodiments may be made and still fall within one or more of the inventions. Accordingly, it should be understood that various features and aspects of the disclosed embodiments can be combine with or substituted for one another in order to form varying modes of the disclosed inventions. Thus, it is intended that the scope of the present inventions herein disclosed should not be limited by the particular disclosed embodiments described above.

What is claimed is:

1. A power generating apparatus comprising:

a frame;

an engine disposed inside the frame and arranged to drive a generator, the engine including an air intake system;

a fuel tank arranged to store fuel to be supplied to the engine; and a canister containing an adsorbent to adsorb fuel vapor from the fuel tank, the canister including a communicating tube arranged to communicate the canister with the atmosphere, and a passage arranged to communicate the canister with the air intake system; wherein the canister is arranged at least partially in a space between the frame and the air intake system; and the canister is arranged to be pivoted away from the air intake system and outward with respect to the frame.

2. The power generating apparatus of claim 1, wherein the communicating tube is located in a bottom portion of the canister and extends downwardly therefrom.

3. The power generating apparatus of claim 1, wherein the intake system includes an air cleaner, the canister being pivotable away from the air cleaner to allow access to the space between the frame and the air intake system thereby facilitating maintenance of the air intake system.

4. The power generating apparatus of claim 1, wherein the canister is completely located in the space between the frame and the air intake system.

5. The power generating apparatus of claim 1, further comprising a pivot support, the pivot support arranged to allow the canister to pivot into and out of the space between the frame and the air intake system.

6. A method for operating a power generating apparatus having a frame, an engine disposed inside the frame, the engine including an air intake system and arranged to drive a generator, a fuel tank arranged to supply fuel to the engine, and a canister containing an adsorbent to adsorb fuel vapor from the fuel tank, the canister pivotally attached to the frame, the method comprising the steps of:

positioning the canister in a space between the frame and the air intake system so that at least a portion of the canister is located in the space;

pivoting the canister out of the space and outwardly from the frame;

accessing the air intake system through the space to perform maintenance thereon; and pivoting the canister into the space between the frame and air intake system when the maintenance is complete.

7. The method of claim 6, wherein the step of positioning the canister includes positioning the canister so that all of the canister is located between the frame and the air intake system.

* * * * *